US011326741B2

(12) United States Patent
McDonald et al.

(10) Patent No.: US 11,326,741 B2
(45) **Date of Patent: *May 10, 2022**

(54) CRYOGENIC STORAGE VESSEL

(71) Applicant: Westport Fuel Systems Canada Inc., Vancouver (CA)

(72) Inventors: Robbi L. McDonald, Richmond (CA); Ankur H. Vayeda, Vancouver (CA); Kenneth W. Kratschmar, Vancouver (CA); Michael Ebbehoj, Vancouver (CA)

(73) Assignee: WESTPORT FUEL SYSTEMS CANADA INC., Vancouver (CA)

( * ) Notice: Subject to any disclaimer, the term of this patent is extended or adjusted under 35 U.S.C. 154(b) by 167 days.

This patent is subject to a terminal disclaimer.

(21) Appl. No.: 16/675,136

(22) Filed: Nov. 5, 2019

(65) Prior Publication Data

US 2020/0124234 A1 Apr. 23, 2020

Related U.S. Application Data

(62) Division of application No. 15/316,068, filed as application No. PCT/CA2015/050494 on May 29, 2015, now Pat. No. 10,480,716.

(30) Foreign Application Priority Data

Jun. 3, 2014 (CA) ..... CA 2853324

(51) Int. Cl.
*F17C 3/04* (2006.01)
*F17C 13/00* (2006.01)
(Continued)

(52) U.S. Cl.
CPC ..... *F17C 13/001* (2013.01); *F02M 21/0221* (2013.01); *F17C 3/04* (2013.01);
(Continued)

(58) Field of Classification Search
CPC .. F17C 3/04; F17C 7/00; F17C 13/025; F17C 2250/0626; F17C 2223/0161;
(Continued)

(56) References Cited

U.S. PATENT DOCUMENTS 2,823,822 A 2/1958 Altman
3,182,462 A 5/1965 Long
(Continued)

FOREIGN PATENT DOCUMENTS

CA 2441775 A1 11/2003
CA 2454458 A1 4/2004
(Continued)

OTHER PUBLICATIONS

Extended European Search Report, dated Jan. 16, 2018, European Patent Office, Corresponding European Patent Application.
(Continued)

*Primary Examiner* — Stephen J Castellano
(74) *Attorney, Agent, or Firm* — Carie C. Mager

(57) ABSTRACT

A cryogenic storage vessel having an inner vessel defining a cryogen space; an outer vessel spaced apart from and surrounding the inner vessel, defining a thermally insulating space between the inner vessel and the outer vessel; and a receptacle defining passages for delivery of liquefied gas from the cryogen space to outside the cryogenic storage vessel. The receptacle has an elongated outer sleeve defining an interior space in fluid communication with the thermally insulating space that is sealed from the cryogen space; an elongated inner sleeve extending into the interior space defined by the elongated outer sleeve defining an inner receptacle space that is fluidly isolated from the thermally insulating space; and a collar extending around an inner surface of the elongated inner sleeve which seals against a cooperating surface of a pump assembly when a pump assembly is installed in the cryogenic storage vessel thereby dividing a warm end from a cold end of the receptacle. A motor for driving the pump can be installed within the cryogenic storage vessel.

20 Claims, 8 Drawing Sheets

(51) Int. Cl.

| | |
|---|---|
| ***F17C 3/08*** | (2006.01) |
| ***F02M 21/02*** | (2006.01) |
| ***F17C 7/00*** | (2006.01) |
| ***F17C 13/02*** | (2006.01) |

(52) U.S. Cl.
CPC ..... *F17C 3/08* (2013.01); *F17C 7/00* (2013.01); *F17C 13/025* (2013.01); *F17C 2201/0109* (2013.01); *F17C 2201/035* (2013.01); *F17C 2203/0391* (2013.01); *F17C 2203/0629* (2013.01); *F17C 2205/0335* (2013.01); *F17C 2221/033* (2013.01); *F17C 2223/0161* (2013.01); *F17C 2223/033* (2013.01); *F17C 2227/0135* (2013.01); *F17C 2227/0178* (2013.01); *F17C 2250/0626* (2013.01); *F17C 2270/0105* (2013.01); *F17C 2270/0168* (2013.01); *F17C 2270/0173* (2013.01)

(58) Field of Classification Search
CPC ..... F17C 2205/0335; F17C 2227/0135; F17C 2203/0629
See application file for complete search history.

(56) References Cited

U.S. PATENT DOCUMENTS

| | | | | |
|---|---|---|---|---|
| 4,435,132 | A | 3/1984 | Haesloop | |
| 4,593,835 | A | 6/1986 | Kikkawa et al. | |
| 4,860,545 | A | 8/1989 | Zwick | |
| 5,477,691 | A | 12/1995 | White | |
| 7,293,418 | B2 | 11/2007 | Noble et al. | |
| 10,480,716 | B2 * | 11/2019 | McDonald | F17C 13/001 |
| 2008/0041091 | A1 | 2/2008 | Allidieres et al. | |
| 2008/0209915 | A1 | 9/2008 | Harper et al. | |
| 2008/0302111 | A1 | 12/2008 | Batenburg et al. | |
| 2015/0114591 | A1 | 4/2015 | Howes | |
| 2016/0138758 | A1 | 5/2016 | Nakano | |

FOREIGN PATENT DOCUMENTS

| | | | |
|---|---|---|---|
| CA | 2853324 | C | 2/2016 |
| CN | 1918424 | A | 2/2007 |
| CN | 101298901 | A | 11/2008 |
| CN | 101346577 | A | 1/2009 |
| CN | 201212615 | Y | 3/2009 |
| CN | 101622491 | A | 1/2010 |
| CN | 201836643 | U | 5/2011 |
| CN | 102927435 | A | 2/2013 |
| CN | 103343879 | A | 10/2013 |
| FR | 1312668 | A | 12/1962 |
| WO | 84/029669 | A1 | 12/2005 |
| WO | 2005121631 | A1 | 12/2005 |

OTHER PUBLICATIONS

International Search Report and Written Opinion dated Jul. 23, 2015, in connection with the corresponding International Patent Application No. PCT/CA2015/050494 having International Publication No. W02015184537A1.
English Translation of CNIPA Search Report, dated Jul. 17, 2018, in connection with correspond CN Patent Application.
Extended European Search Report, dated Feb. 12, 2019, European Patent Office, Corresponding European Patent Application.

* cited by examiner

CRYOGENIC STORAGE VESSEL

This application is a divisional of application Ser. No. 15/316,068 filed 2 Dec. 2016, now U.S. Pat. No. 10,480,716, which is the national stage (Rule 371) of international application No. PCT/CA2015/050494 filed 29 May 2015.

FIELD OF THE INVENTION

The present application relates to a cryogenic storage vessel and more particularly to a double walled cryogenic storage vessel with a pump receptacle.

BACKGROUND OF THE INVENTION

Gaseous fuels are employed to fuel internal combustion engines. In some applications, when there is a need to store a large quantity of fuel, and when there is limited space for storing such fuel, for example on board a vehicle, it is known to increase fuel storage density, thereby increasing vehicle operating range, by storing gaseous fuels, like natural gas, in liquefied form (LNG). A cryogenic storage vessel can typically store about four times more fuel compared to a like-sized storage vessel containing compressed natural gas (CNG). To deliver the gaseous fuel to the engine, a cryogenic pump is employed to pressurize the gaseous fuel to injection pressure, while it is still in liquefied form. The fuel is typically vaporized after being pumped so it is no longer in liquefied form when it is delivered to the engine. The delivery pressure can be within a wide range of pressures depending upon the design of the engine, and whether the downstream injection system is a low pressure or high pressure injection system. For example, among other factors, the delivery pressure depends upon whether the fuel is introduced into the intake air system, or directly into the combustion chamber, and if into the combustion chamber, the timing when it is introduced.

In known systems, the cryogenic pump can be situated in an external sump separate from the cryogen space defined by the cryogenic storage vessel, or can be installed with the pump assembly extending into the cryogen space as disclosed in the Applicant's co-owned U.S. Pat. No. 7,293,418. There are several advantages to installing the cryogenic pump assembly with the pump portion immersed in the liquefied gas and the drive portion on the outside of the cryogen space, including reduced start time for the pump, because unlike external pumps, which require time to be cooled to cryogenic temperatures to operate efficiently a pump that is located inside the cryogen space is maintained at cryogenic temperatures so long as there is liquefied gas stored inside the cryogenic vessel. In addition, when an external sump is connected to the cryogen space by piping such piping must be thermally insulated to reduce heat leak and vaporization of the liquefied fuel before it flows to the sump and then eventually to the pump.

A gaseous fuel is any fuel that is in a gaseous state at standard temperature and pressure, which in the context of this application is 20 degrees Celsius (° C.) and 1 atmosphere (atm). By way of example, typical gaseous fuels that can be stored in liquefied form include, without limitation, natural gas, propane, hydrogen, methane, butane, ethane, other known fuels with similar energy content, and mixtures including at least one of these fuels. Natural gas itself is a mixture, and it is a popular gaseous fuel for internal combustion engines because it is abundant, less expensive and cleaner burning than oil-based liquid fuels, and the sources are broadly dispersed geographically around the world. A purified form of LNG previously used in experimental railroad applications is referred to as refrigerated liquid methane (RLM).

In high horsepower applications, such as marine, mining and railroad applications, the quantity of fuel consumed by each engine, compared to an engine used for trucking applications is considerably greater. Accordingly, applications that consume more fuel require larger fuel storage vessels. As an example, a tender car comprising a cryogenic storage vessel for a locomotive can carry over 27,000 gallons of liquefied natural gas (LNG), compared to a typical 150 gallon capacity for a cryogenic storage vessel employed on a heavy duty truck. In trucking applications, when the cryogenic pump requires servicing, the storage vessel can be drained when the pump is removed. In high horsepower applications because of the much larger size of the fuel storage vessel and the much larger amount of liquefied fuel that can be stored therein, it is impractical, time consuming, and expensive to drain the liquefied fuel from the cryogenic storage vessel when the cryogenic pump must be removed for servicing.

The high horsepower internal combustion engines described above employ a maximum fuel flow rate that is considerably greater compared to heavy duty engines used for on-highway trucks. As an example, in certain applications a cryogenic pump for a high horsepower engine can deliver fuel at a maximum average rate on the order of 1000 kilograms per hour, whereas a cryogenic pump for a heavy duty engine can deliver fuel at a maximum average rate of about 100 kilograms per hour. The larger fuel flow capacity requires a pump of considerably larger size and mass, and such a pump has unique mounting and support requirements when installed in a cryogenic vessel compared to smaller pumps. In mobile applications there can be axial, transverse, radial, and rotational loads acting on the pump, which if not constrained properly can lead to fatigue in pump supports that secure the pump to the cryogenic vessel and undue stress on the cryogenic vessel itself.

When a cryogenic pump assembly has its pump portion installed within a cryogenic storage vessel there can be a dead volume of fuel at the bottom of the vessel that is inaccessible to the cryogenic pump. This dead volume represents a cash investment into the operating cost of the cryogenic storage vessel and pump over the entire lifetime of the equipment, since the dead volume is always present when the pump is operating. It is desirable to reduce the dead volume of fuel as much as possible, without unduly increasing the cost of the cryogenic storage vessel and reducing the operating efficiency of the pump.

The state of the art is lacking in techniques for cryogenic storage vessels that securely mount a cryogenic pump assembly with the pump portion on the end that extends into the cryogen space to reduce dead volume and with features for installing and removing the pump assembly without draining the liquefied fuel from the cryogen space.

SUMMARY OF THE INVENTION

An improved cryogenic storage vessel comprises an inner vessel defining a cryogen space, and an outer vessel spaced apart from and surrounding the inner vessel, defining a thermally insulating space between the inner vessel and the outer vessel. A receptacle defines passages for delivery of liquefied gas from the cryogen space to outside the cryogenic storage vessel. The receptacle comprises an elongated outer sleeve and an elongated inner sleeve. The elongated outer sleeve has a longitudinal axis intersecting opposite sides of the inner vessel, with the opposite ends of the elongated outer sleeve defining an interior space in fluid communication with the thermally insulating space that is sealed from the cryogen space. The elongated inner sleeve has an open end supported from the outer vessel, with the elongated inner sleeve having a longitudinal axis extending into the interior space defined by the elongated outer sleeve. The elongated inner sleeve also has a closed end opposite the open end, thereby defining a receptacle space that is fluidly isolated from the thermally insulating space. A fluid communication channel extends from the cryogen space to the receptacle space. The fluid communication channel has a flexible construction that allows movement of the elongated inner sleeve relative to the elongated outer sleeve. The flexible construction can comprise a bellows arrangement. The receptacle is vertically oriented with a lower end. The lower end and the fluid communication channel are both located near the bottom of the cryogen space. A pump can be disposed inside the receptacle space with in inlet near the lower end.

In a preferred embodiment, there is a valve operable between an open position and a closed position to control fluid flow between the cryogen space and the receptacle space. The valve can be located in the fluid communication channel, or at other locations between the cryogen space and the receptacle space. The valve can be a check valve, such as a wafer-type check valve for example, that is biased to stop fluid from flowing out of the cryogen space unless it is actuated into an open position. In a preferred embodiment, the valve is actuated mechanically from outside the cryogenic storage vessel by activating a valve actuator that actuates a link operatively connected with the valve actuator and the valve. The link can extend through a conduit that extends between the valve actuator and the valve, which is fluidly isolated from the thermally insulating space and the interior space. The link can comprise a rod and a cable, where the rod is operatively connected with the valve actuator and the cable is operatively connected with the valve. There can be a sensor that detects the position of the cryogenic storage vessel, and a severing mechanism operatively connected with the sensor to sever the connection between one of (a) the link and the valve and (b) the link and the valve actuator, when the sensor detects an emergency condition. In another preferred embodiment, the valve automatically opens when a pump is installed inside the receptacle, and the valve is automatically closed when the pump is removed from the receptacle.

The closed end of the elongated inner sleeve can be supported by a guide that constrains movement in directions transverse to its longitudinal axis. Alternatively or additionally, the guide constrains at least one of axial movement of the elongated inner sleeve and rotational movement of the elongated inner sleeve. The elongated inner sleeve and a pump assembly have cooperating surfaces that seal against each other when the pump assembly is installed within the elongated inner sleeve, thereby limiting the height within the elongated inner sleeve into which the liquefied gas can rise. The cooperating surfaces can be formed by a collar that forms a ledge inside the elongated inner sleeve and a flange associated with the pump assembly.

The cryogenic storage vessel further comprises a collar extending around an inner surface of the inner receptacle and fluidly dividing the inner receptacle into a warm end and a cold end when a pump assembly is installed in the receptacle. There is a purge valve in fluid communication with a supply of pressurized purging gas, and a first purge conduit fluidly connecting the purge valve with the warm end, and a second purge conduit fluidly connecting the purge valve with the cold end. There is a drain valve in fluid communication with one of a second storage vessel and the cryogen space, a first drain conduit fluidly connecting the drain valve with the warm end, and a second drain conduit fluidly connecting the drain valve with the cold end. In preferred embodiments there is a gaseous fuel concentration sensor that detects the concentration of gaseous fuel downstream from the drain valve, thereby indirectly detecting the concentration of gaseous fuel in the receptacle space to determine when draining is completed, and a pressure sensor detecting the pressure downstream from the drain valve.

In another preferred embodiment, there is a well beneath the outer vessel into which the receptacle space and the fluid communication channel extend, and a valve for selectively fluidly connecting the cryogen space with the receptacle space through the fluid communication channel.

There is an improved receptacle for a pump in a cryogenic storage vessel comprising an inner vessel defining a cryogen space, an outer vessel spaced apart from and surrounding the inner vessel, defining a thermally insulating space between the inner vessel and the outer vessel. The receptacle defines passages for delivery of liquefied gas from the cryogen space to outside the cryogenic storage vessel. The receptacle comprises an elongated outer sleeve that has a longitudinal axis intersecting opposite sides of the inner vessel, with the opposite ends of the elongated outer sleeve defining an interior space in fluid communication with the thermally insulating space that is sealed from the cryogen space. And an elongated inner sleeve with an open end supported from the outer vessel, with the elongated inner sleeve having a longitudinal axis extending into the interior space defined by the elongated outer sleeve. The elongated inner sleeve has a closed end opposite the open end, thereby defining a receptacle space that is fluidly isolated from the thermally insulating space. A fluid communication channel extends from the cryogen space to the receptacle space. In a preferred embodiment there is a valve operable between an open position and a closed position to control fluid flow between the cryogen space and the receptacle space through the fluid communication channel.

DETAILED DESCRIPTION OF PREFERRED EMBODIMENT(S)

Figure 1:
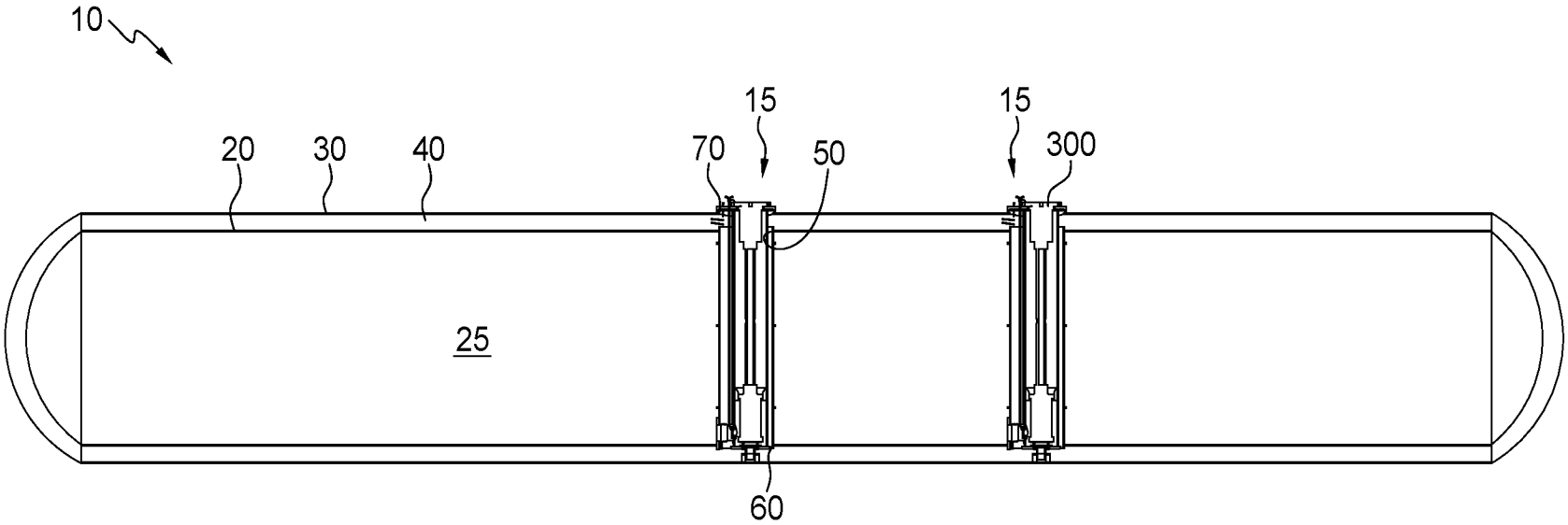
FIG. 1 is a partial cross-sectional view of a cryogenic storage vessel according to a first embodiment.
Figure 2:
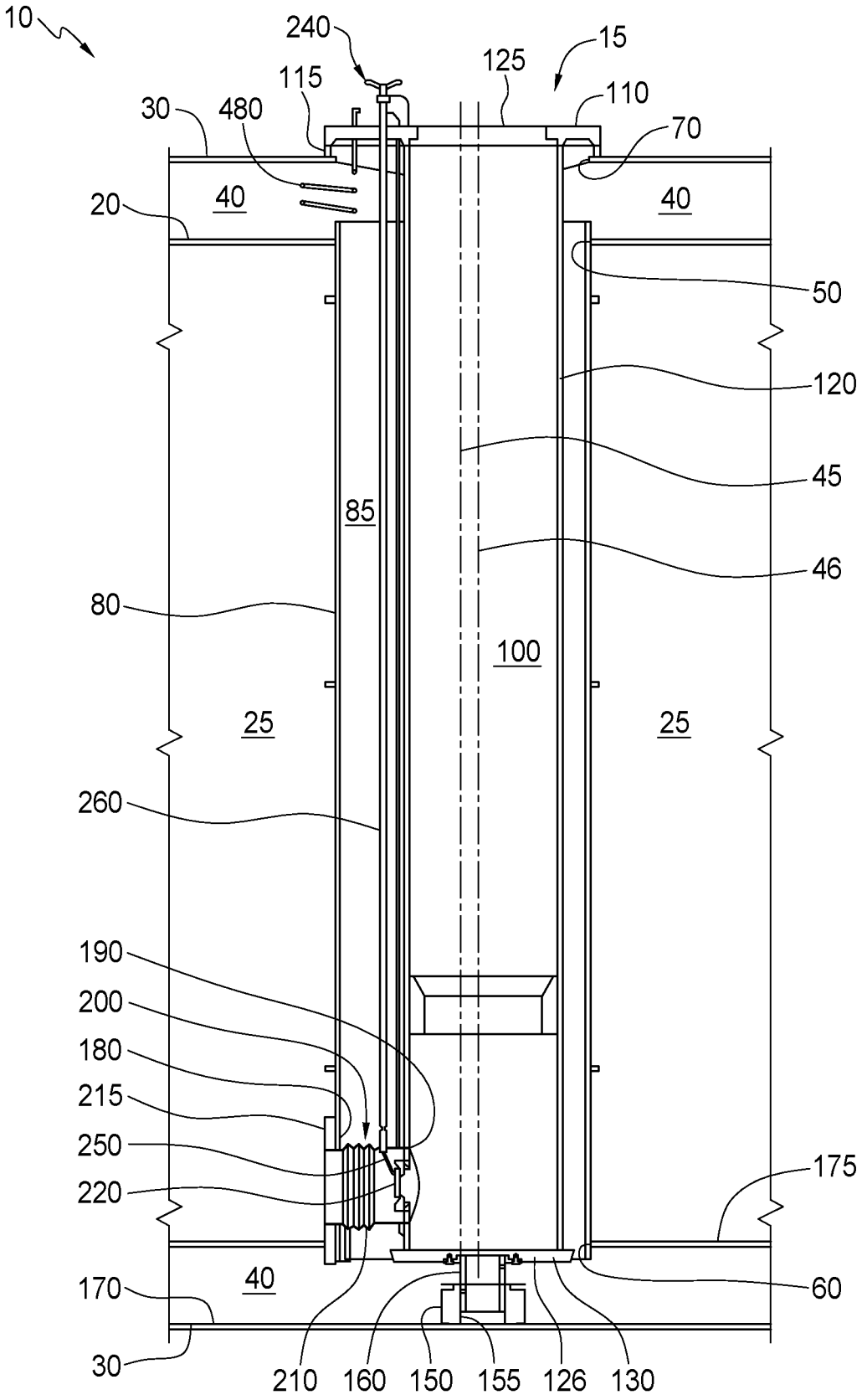
FIG. 2 is a partial cross-sectional view of a pump receptacle in the cryogenic storage vessel of FIG. 1.

Referring to FIGS. 1 and 2, there is shown cryogenic storage vessel 10 according to a first embodiment, which is the type that employs a vacuum space between inner and outer vessels to reduce heat leak into the vessel. Inner vessel 20 stores liquefied gaseous fuel in cryogen space 25 and is surrounded by and spaced apart from outer vessel 30 thereby defining thermally insulating space 40 (the vacuum space). In the illustrated embodiment cryogenic storage vessel 10 extends longitudinally in a horizontal plane, and such a configuration is suitably employed in a variety of high horsepower applications, for example on a tender car for supplying fuel to a locomotive and as a storage vessel in a power generation application. Cryogenic storage vessel 10 can comprise one or more receptacles 15, in which cryogenic pump assemblies 300 are disposed. Multiple pumps provide redundancy that is useful if one pump fails to operate, and to increase flow capacity when more than one pump is operated at the same time or alternatively a plurality of pumps can be operated independently to supply fuel to multiple downstream consumers. Receptacles 15 define passages for delivery of liquefied gas from cryogen space 25 to outside cryogenic storage vessel 10. Elongated outer sleeve 80 has longitudinal axis 45 that intersects opposite sides of inner vessel 20. Opposite ends of outer sleeve 80 define interior space 85 that is in fluid communication with insulating space 40 and is sealed from cryogen space 25. Elongated inner sleeve 120 comprises open end 125, which is supported from outer vessel 30, and longitudinal axis 46 extending into interior space 85 defined by outer sleeve 80. In the illustrated embodiment inner sleeve 120 is not coaxial with outer sleeve 80, although this is not a requirement. Inner sleeve 120 has closed end 126 opposite open end 125, thereby defining receptacle space 100 that is fluidly isolated from thermally insulating space 40. Fluid communication channel 200 extends from cryogen space 25 to receptacle space 100. Valve 220 is operable between an open position and a closed position to control fluid flow between cryogen space 25 and receptacle space 100 in inner sleeve 120.

Inner vessel 20 comprises bore 50 located opposite bore 60, and outer vessel 30 comprises bore 70, and these bores are arranged such that when vessel 10 is assembled the bores are at least axially overlapping. In preferred embodiments bores 50, 60 and 70 are generally circular or oval in shape. Outer sleeve 80 extends axially between bores 50 and 60, and annularly around inner sleeve 120. There are fluid seals, such as for example welds, between outer sleeve 80 and inner vessel 20 around bores 50 and 60. In this disclosure unless otherwise mentioned fluid seals between structural components comprise welds, but other known fluid sealing techniques can be employed.

Support flange 110 is fluidly sealed with inner sleeve 120 at open end 125. Flange 115 extends outwardly from an outer perimeter of support flange 110 and is fluidly sealed with outer vessel 30 around bore 70. At closed end 126, end cap 130 is fluidly sealed with inner sleeve 120. Guide 150 is rigidly secured to an inner surface of outer vessel 30 at floor 170. Protrusion 160 extends from a bottom surface of end cap 130 into bore 155 of guide 150, thereby restricting transverse and radial movement of inner sleeve 120 near end cap 130 with respect to longitudinal axis 46. Inner sleeve 120 is suspended from outer vessel 30 such that protrusion 160 does not contact floor 170, allowing freedom of axial motion during thermal contractions. In another preferred embodiment a compression spring can be arranged in bore 155 between protrusion 160 and floor 170 such that a portion of the axial load of receptacle 15, and of pump assembly 300 when installed, is supported by the floor of outer vessel 30. In other embodiments guide 150 and protrusion 160 are not required and inner sleeve 120 can be rigidly secured by the connection between support flange 110 and outer vessel 30, although this increases the stress on support flange 110 and is not preferred. In still further embodiments guide 150 can be keyed with respect to protrusion 160 such that rotation of inner sleeve 120 with respect to guide 150 is constrained.

Figure 3:
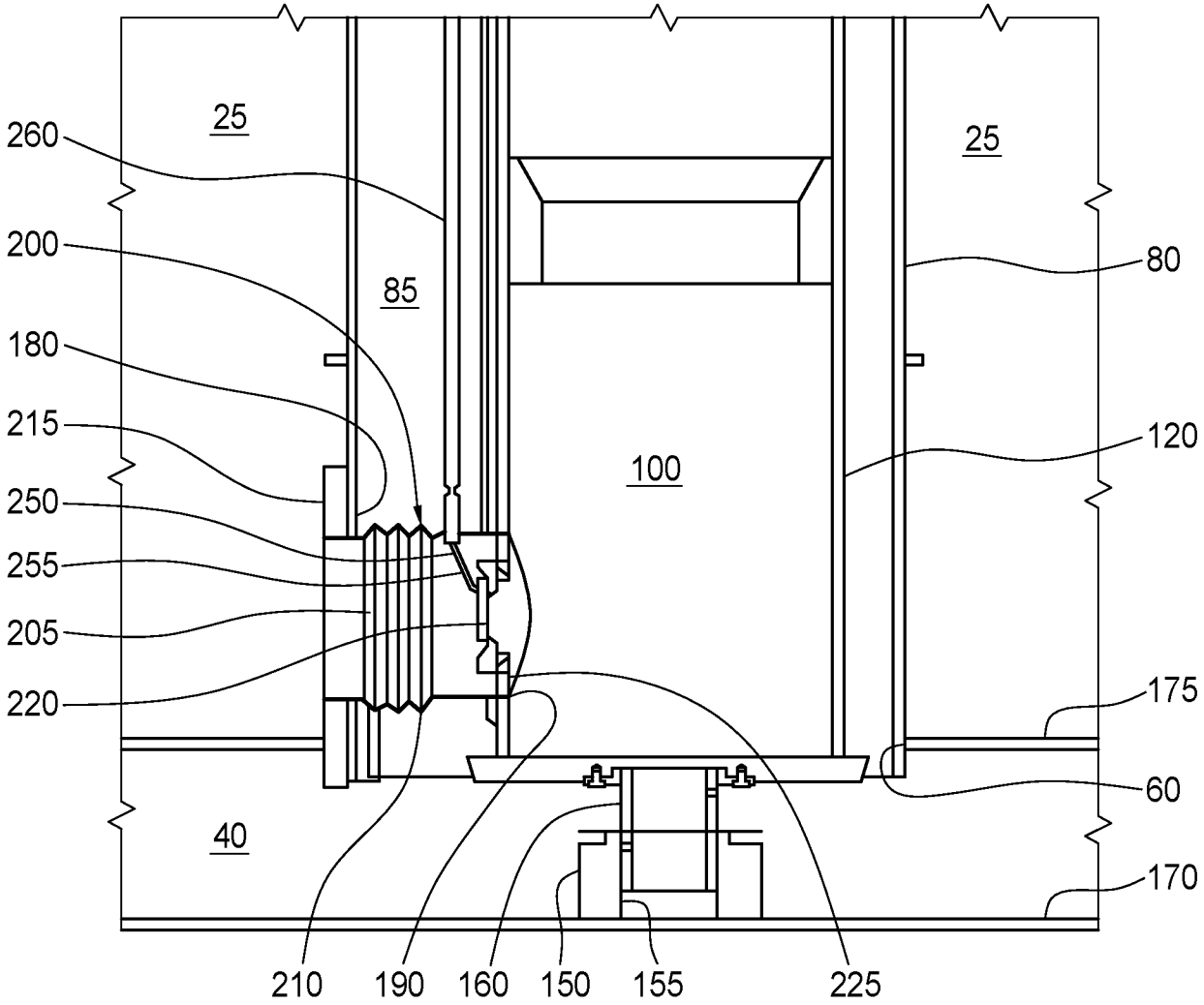
FIG. 3 is a partial cross-sectional view of a fluid communication channel between a cryogen space and a receptacle space of the pump receptacle of FIG. 2.
Figure 4:
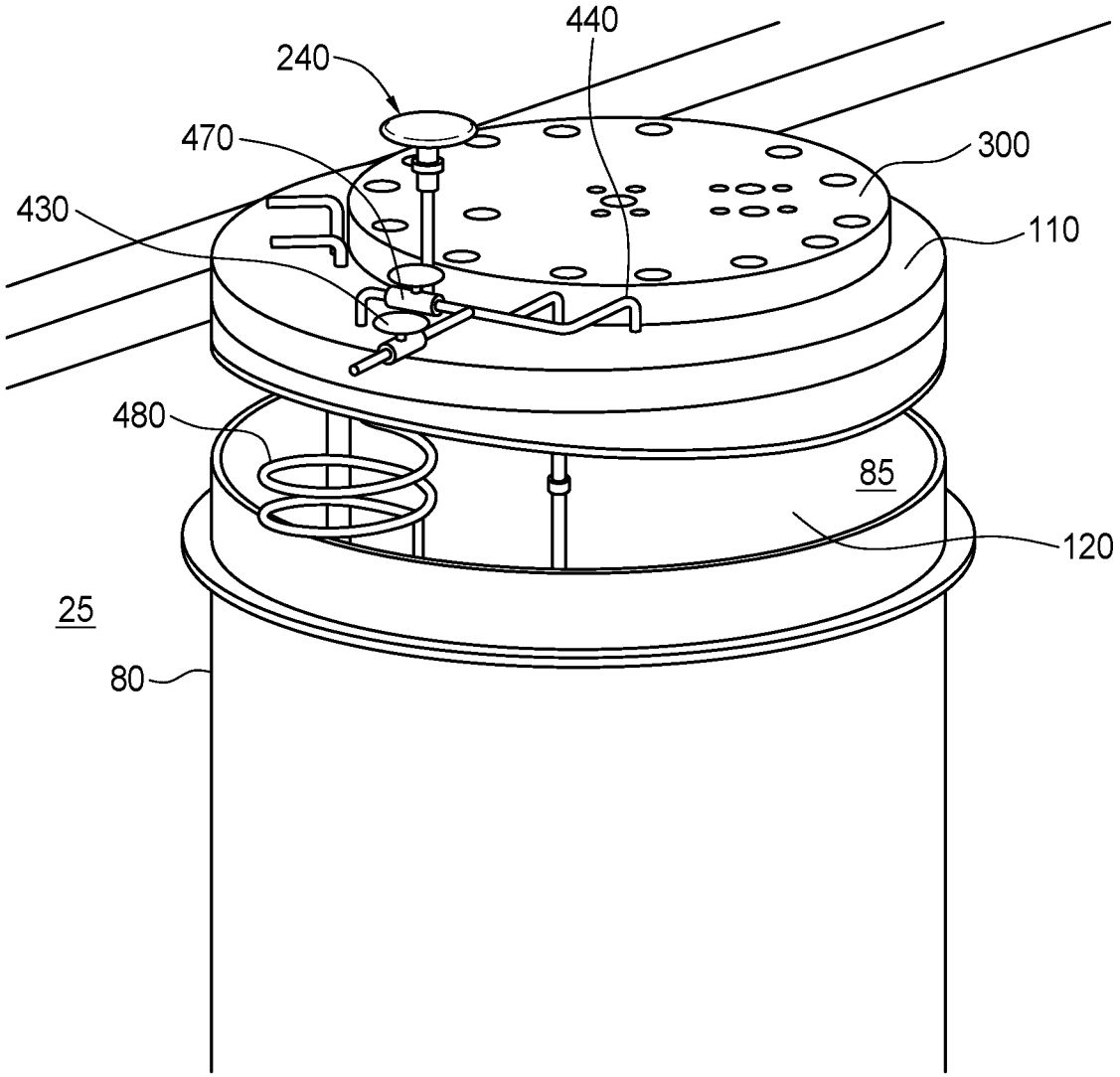
FIG. 4 is a partial view in perspective of an upper end of the pump receptacle of FIG. 2 illustrated with a cryogenic pump assembly installed.

With reference to both FIGS. 2 and 3, fluid communication channel 200 extends from cryogen space 25 to receptacle space 100. In a preferred embodiment fluid communication channel 200 comprises tubular bellows 210 of flexible construction, which allows outer sleeve 80 to move with respect to inner sleeve 120 as cryogenic storage vessel 10 is thermally cycled between ambient temperature and cryogenic temperatures, extending between bore 180 in outer sleeve 80 and bore 190 in inner sleeve 120. Inner space 205 of tubular bellows 210 is fluidly isolated from interior space 85, and in fluid communication with cryogen space 25, and in selective fluid communication with receptacle space 100. In the illustrated embodiment, tubular bellows 210 extends through bore 180 and is fluidly sealed with annular flange 215, and the annular flange is fluidly sealed with outer sleeve 80 around bore 180. By allowing end cap 130 to extend towards floor 170 and preferably through bore 60 in inner vessel 20, fluid communication channel 200 can be situated closer to floor 175 of the inner vessel, thereby reducing the dead volume and increasing the useable amount of fuel contained in cryogen space 25. This is facilitated by outer sleeve 80 having open ends and extending between bores 50 and 60, such that interior space 85 is in fluid communication with thermally insulating space 40 from both ends of outer sleeve 80. In other embodiments a sump can be included in and below outer vessel 30 allowing fluid communication channel 200 to be situated even closer to floor 175. Valve 220 allows selective fluid communication between cryogen space 25 and receptacle space 100 through bellows 210, and in the illustrated embodiment the valve is a wafer-type check valve bolted to annular flange 225 arranged in bore 190 such that if the valve becomes damaged it can be replaced after emptying the cryogenic storage vessel. In other embodiments valve 220 can be arranged at various locations along fluid communication channel 200. As will be explained in more detail below, valve 220 allows installation and removal of a cryogenic pump into and out of receptacle 15 without first requiring cryogen space 25 to be drained of liquefied gaseous fuel. Valve actuator 240 (seen in FIG. 2) is operatively connected to valve 220 through link 250, which extends through conduit 260. Conduit 260 provides a fluidly sealed passageway between actuator 240 and tubular bellows 210 through interior space 85, and which is fluidly sealed with support flange 110. Referring to FIGS. 2, 3 and 4, the upper portion of cryogen space 25, also known as the vapor space, can fluidly communicate with receptacle space 100 through passageway 480, valve 470 (which can be selectively opened and closed) and passageway 440, to allow the pressure in the cryogen space to equalize with the pressure in the receptacle space to facilitate the opening of valve 220, which otherwise must be opened against a substantial pressure head of the liquefied gaseous fuel in cryogen space 25. In a preferred embodiment link 250 comprises a rod (inside tube 260) connected with cable 255 (best seen in FIG. 3) that is connected to valve 220. The rod is sealed with tube 260 by a gas seal (not shown), such as an o-ring or the like, to reduce and preferably prevent any vaporized gaseous fuel from escaping through the tube. Valve actuator 240 comprises a rotatable handle that, when turned in one direction, pulls the rod upwards thereby opening valve 220, and when turned in the opposite direction pushes the rod of link 250 downwards creating slack in cable 255 such that the valve closes when the pressure in cryogen space 25 is greater than the pressure in receptacle space 100. Check valve 220 can also be spring loaded such that it closes without requiring a pressure differential between cryogen space 25 and receptacle space 100. Alternatively, in other embodiments, valve actuator 240 and link 250 can be integrated with pump assembly 300 such that link 250 actuates valve 220 from within receptacle space 100 instead of interior space 85, and in this circumstance conduit 260 is not required. In still further embodiments, link 250 can automatically open valve 220 when pump assembly 300 is installed in receptacle 15, and when the pump assembly 300 is removed valve 220 automatically closes, and in this circumstance actuator 240 is not required. In the event of an emergency valve 220 can be closed automatically by severing the connection between the valve and link 250, or between the link and actuator 240, which allows the valve to close when the valve is the type that is biased to the closed position. When the cryogenic storage vessel is a tender car supply liquefied gaseous fuel to a locomotive, an emergency situation can be when the train derails and the tender car overturns. A sensor, such as a gyroscope or accelerometer, can detect, either directly or indirectly, the current position of the tender car and activate a severing mechanism, such as a break-away connection known in the locomotive industry, to allow valve 220 to close.

Figure 5:
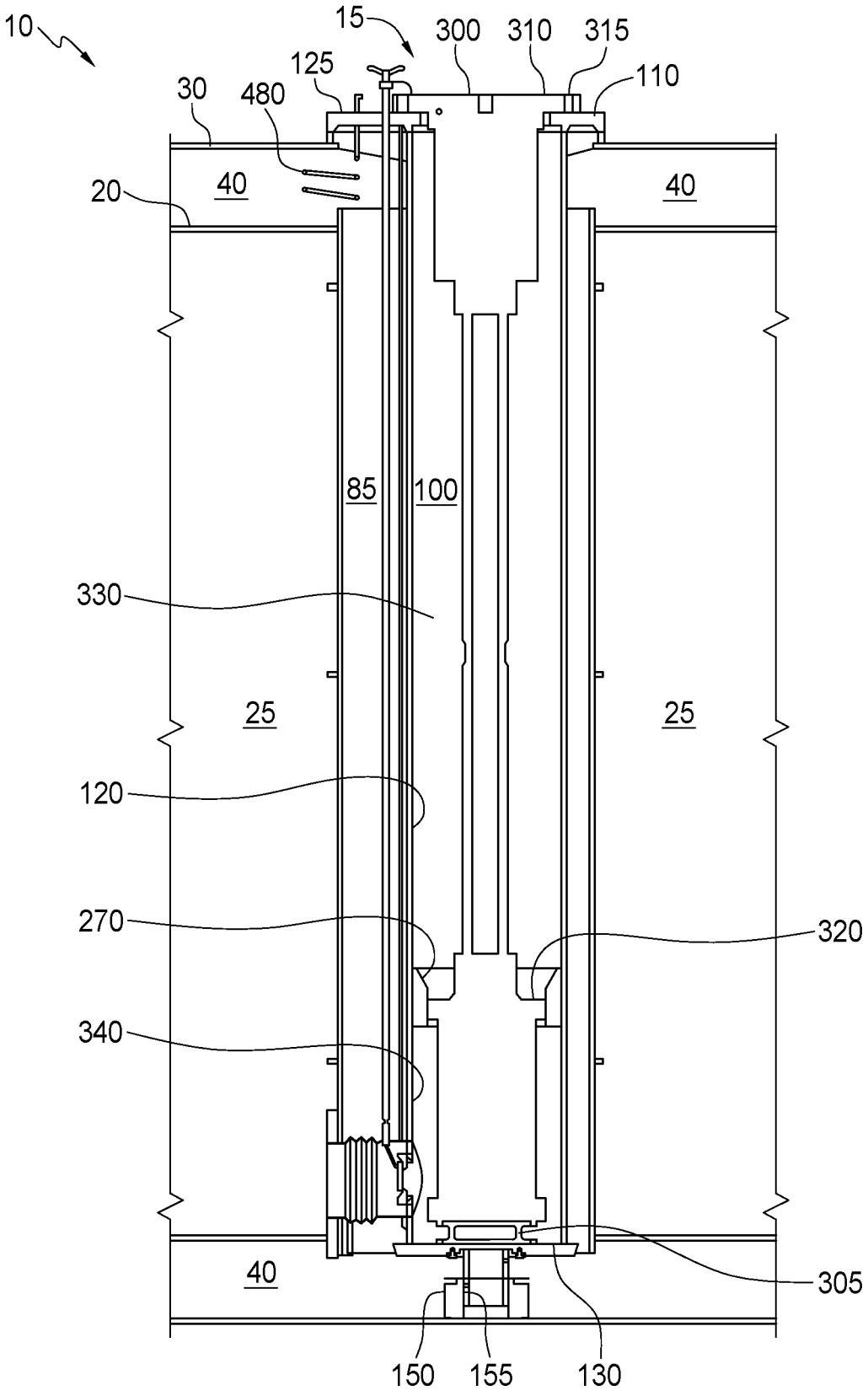
FIG. 5 is a partial cross-sectional view of a cryogenic pump installed in the pump receptacle of FIG. 2.

Referring now to FIG. 5, cryogenic pump assembly 300 is illustrated installed in receptacle 15. Flange 310 of cryogenic pump assembly 300 is fluidly sealed with support flange 110 and secured thereto by fasteners 315. Outer vessel 30 bears the axial load of cryogenic pump assembly 300 through support flange 110, in addition to radial loads (transverse loads), and rotational loads (torsional loads) at open end 125. The radial loads of cryogenic pump assembly 300 at end 305 of the assembly is transmitted to outer vessel 30 through end cap 130, protrusion 155 and guide 150. Flange 320 on cryogenic pump assembly 300 cooperates with a ledge on collar 270 that is connected with inner sleeve 120 to form a liquid seal, dividing receptacle space 100 into warm end 330 and cold end 340. In a preferred embodiment cryogenic pump assembly 300 comprises a hydraulic motor in warm end 330 and a reciprocating piston pump in cold end 340, driven by the motor. When valve 220 is open, liquefied gaseous fuel flows from cryogen space 25 into cold end 340, and during suction strokes of cryogenic pump assembly 300 into an intake of the reciprocating piston pump.

Figure 6:
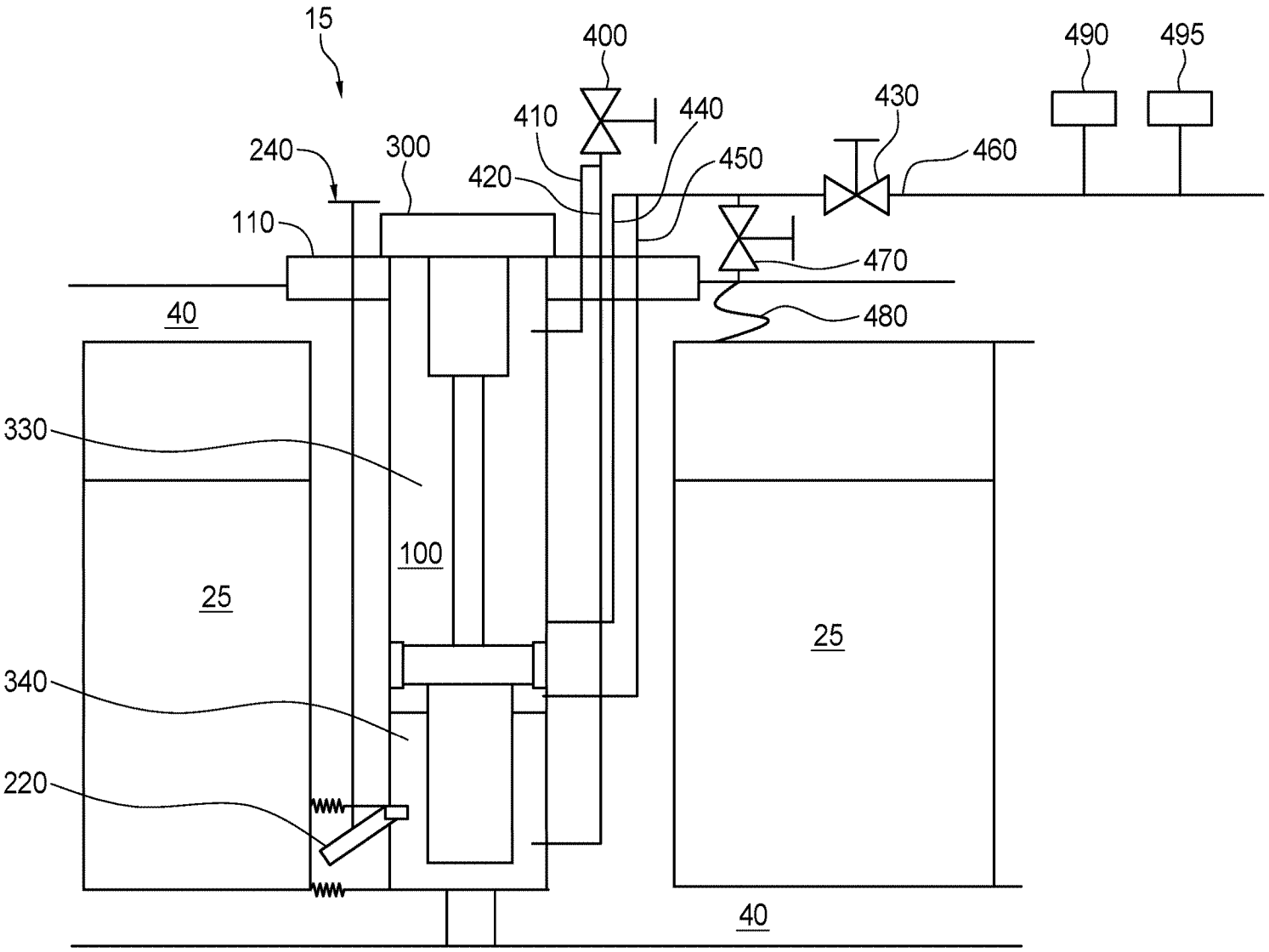
FIG. 6 is a partial cross-sectional view of the pump receptacle of FIG. 2 with purge conduits and valves and drain conduits and valves.
Figure 7:
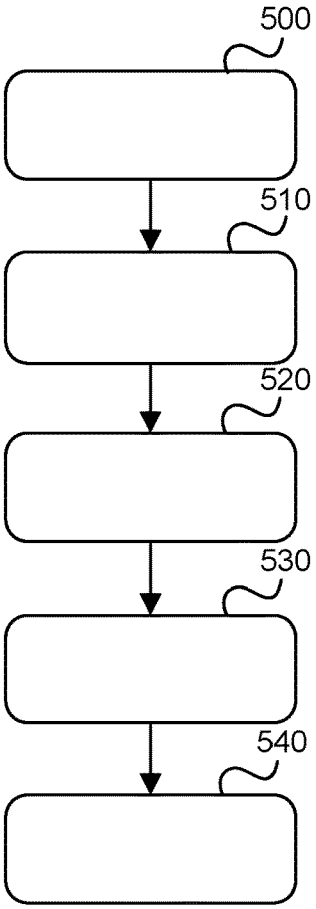
FIG. 7 is a flow chart view of a procedure for removing the cryogenic pump of FIG. 4 from the pump receptacle of FIG. 2.

Referring now to FIG. 7, the procedure for removing cryogenic pump assembly 300 from receptacle 15 is now described with reference to FIG. 6. First, valve 470 is closed to fluidly isolate receptacle space 100 from the vapour space in cryogen space 25 (step 500 in FIG. 7). Next, valve 220 is closed to fluidly isolate cold end 340 from cryogen space 25 (step 510) by activating valve actuator 240 accordingly and opening valve 430 to reduce the pressure in receptacle space 100 below the pressure in cryogen space 25 such that valve 220 closes due to the pressure differential (step 510). Conduit 460 after valve 430 leads to a storage vessel where the pressure is much less than the pressure in receptacle space 100. After valve 220 is closed, valve 400 is opened to allow a purging gas to enter conduits 410 and 420 under pressure (step 520). The purging gas is denser than the vaporized gaseous fuel, but not denser than the liquefied gaseous fuel. For example, the purging gas can be nitrogen and the gaseous fuel can be natural gas. In warm end 330, a flow of purging gas is established between conduit 410 and conduit 440 that entrains the vaporized gaseous fuel into conduit 440. In cold end 340, purging gas enters through conduit 420 into a pool of liquefied gaseous fuel causing it to boil, since the temperature of the purging gas is well above cryogenic temperatures and acts as a heat exchange fluid. As the liquefied gaseous fuel vaporizes it escapes through conduit 450 under pressure of the purging gas, which establishes a flow between conduit 420 and conduit 450. Pressure sensor 495 indirectly monitors the pressure in receptacle space 100 (through monitoring the pressure in conduit 460) such that the pressure in the receptacle space due to the pressurized purging gas can be prevented from rising above the pressure in cryogen space 25, which if it did would cause valve 220 to open when the pressure differential is sufficient to urge the valve open. Conduit 460 delivers the drained gaseous fuel to a storage facility (not shown). Sensor 490 detects the concentration of gaseous fuel in conduit 460 to determine when warm end 330 and cold end 340 have been purged of gaseous fuel, after which valve 400 is closed (step 530). After the pressure reaches 0 pounds per square inch (psig) in receptacle space 100, as determined by pressure sensor 495, pump assembly 300 is disconnected and extracted from receptacle 15 (step 540). Valve 430 can remain open to ensure that the pressure remains at 0 psig.

Figure 8:
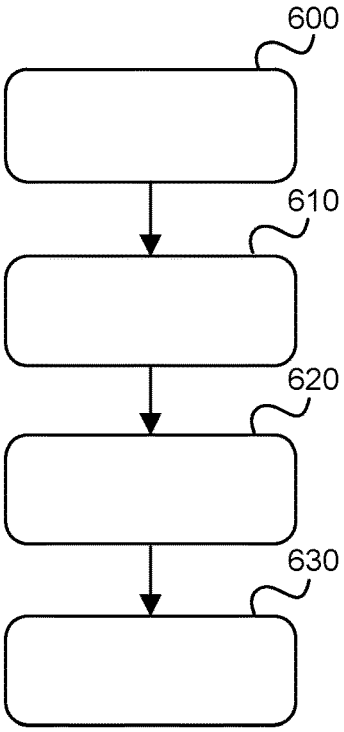
FIG. 8 is a flow chart view of a procedure for installing the cryogenic pump of FIG. 4 into the pump receptacle of FIG. 2.

Referring now to FIG. 8, the procedure for installing cryogenic pump assembly 300 is now described with reference to FIG. 6. Cryogenic pump assembly 300 is inserted in receptacle 15 and secured to support flange 110 (step 600). Valves 400 and 430 are opened to allow a flow of purging gas through receptacle 100 and out conduit 460 to evacuate air and moisture in the receptacle, which is allowed to flow for a predetermined amount of time, after which these valves are closed (step 610). Valve 470 is opened to equalize the pressure between receptacle space 100 and cryogen space 25 (step 620). The pressure balance between cryogen space 25 and receptacle space 100 reduces the force required to open valve 220 when valve actuator 240 is activated (step 630), allowing liquefied gaseous fuel to flow into cold end 340. The opening of valve 220 can be delayed for a predetermined amount of time to allow cryogenic pump assembly 300 to cool down through heat transfer between the pump assembly and the liquefied gaseous fuel in cryogen space 25. When valve 220 opens, any vaporized gaseous fuel in cold end 340, that was introduced when valve 470 was opened, will flow through conduit 450 through valve 470 into cryogen space 25.

Figure 9:
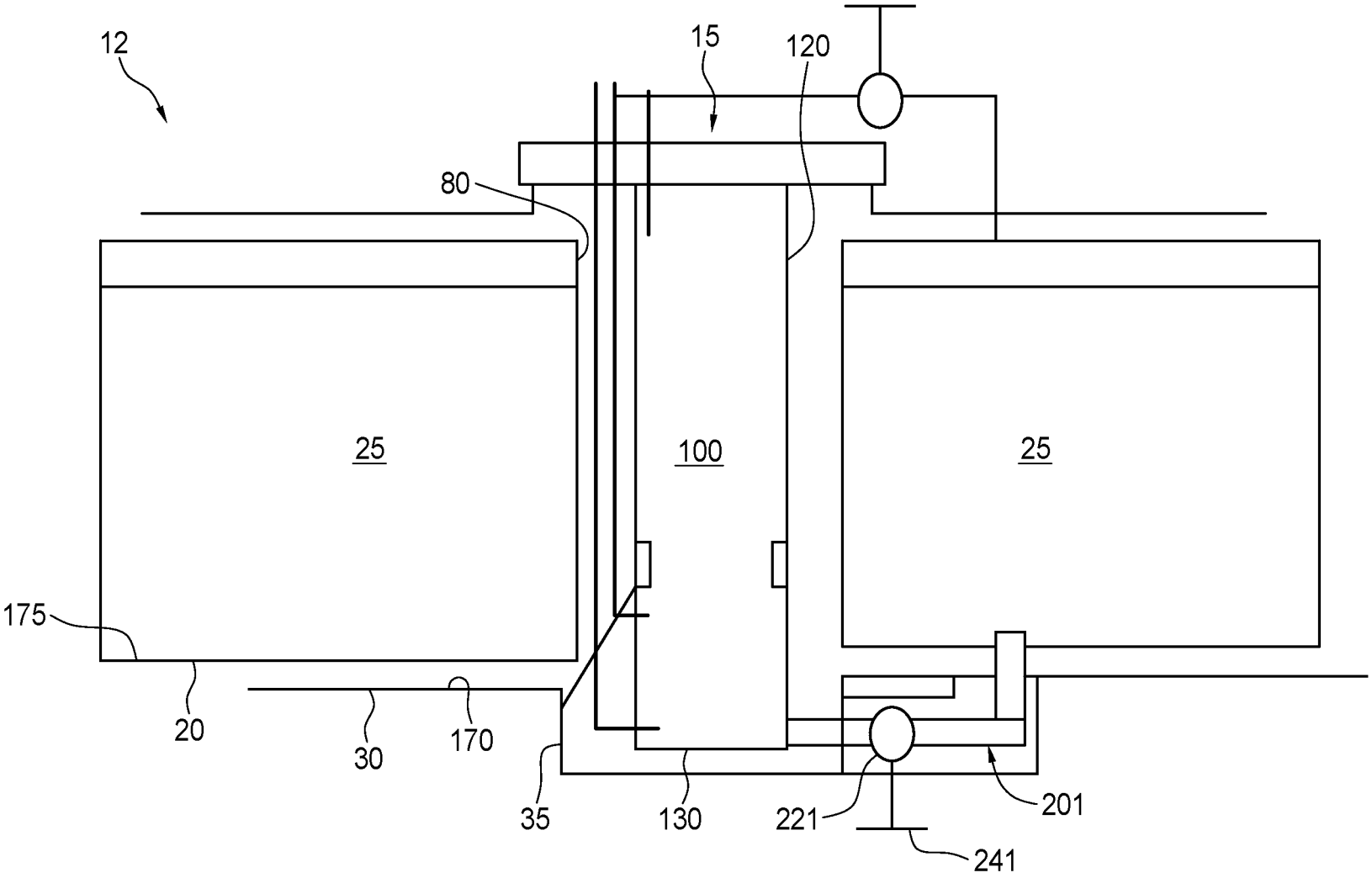
FIG. 9 is a partial cross-sectional view of a cryogenic storage vessel according to a second embodiment.

Referring to FIG. 9, there is shown cryogenic storage vessel 12 according to a second embodiment that is similar to the first embodiment where like parts to this embodiment have like reference numerals and may not be described in detail if at all. Outer vessel 30 comprises well 35, also known as a sump, that extends below floor 170, and into which extends end cap 130 of pump receptacle 15. Fluid communication channel 201 extends from cryogen space 25 outside of and below outer vessel 30 to receptacle space 100 through well 35. Valve 221 is selectively opened and closed by valve actuator 241. This embodiment has the advantage of reducing dead volume compared to the first embodiment of FIG. 2 since fluid communication channel 201 is below floor 175 of inner vessel 20, and valve actuator 241 can be located near the bottom of cryogenic storage vessel 12 for convenient access by maintenance personnel from ground level. The first embodiment has at least the advantage of simplified construction of outer vessel 30.

While particular elements, embodiments and applications of the present invention have been shown and described, it will be understood, that the invention is not limited thereto since modifications can be made by those skilled in the art without departing from the scope of the present disclosure, particularly in light of the foregoing teachings.

We claim:

1. A cryogenic storage vessel comprising:

an inner vessel defining a cryogen space;

an outer vessel spaced apart from and surrounding the inner vessel, defining a thermally insulating space between the inner vessel and the outer vessel;

a receptacle defining passages for delivery of liquefied gas from the cryogen space to outside the cryogenic storage vessel; the receptacle comprising:

an elongated outer sleeve defining an interior space in fluid communication with the thermally insulating space that is sealed from the cryogen space;

an elongated inner sleeve with an open end supported from the outer vessel, with the elongated inner sleeve having a longitudinal axis extending into the interior space defined by the elongated outer sleeve and defining an inner receptacle space that is fluidly isolated from the thermally insulating space; and a ledge on a collar extending around an inner surface of the elongated inner sleeve which forms a liquid seal against a cooperating surface of a pump assembly when a pump assembly is installed in the cryogenic storage vessel thereby dividing a warm end from a cold end of the receptacle.

2. The cryogenic storage vessel of claim 1, further comprising a fluid communication channel extending from the cryogen space to the receptacle space.

3. The cryogenic storage vessel of claim 2, further comprising a valve operable between an open position and a closed position to control fluid flow between the cryogen space and the receptacle space.

4. The cryogenic storage vessel of claim 3, wherein the valve is a check valve that is biased to stop fluid from flowing out of the cryogen space unless it is actuated into an open position.

5. The cryogenic storage vessel of claim 3, wherein the valve is automatically opened when a pump is installed inside the receptacle, and the valve is automatically closed when the pump is removed from the receptacle.

6. The cryogenic storage vessel of claim 3, wherein the valve is actuated mechanically from outside the cryogenic storage vessel.

7. The cryogenic storage vessel of claim 6, further comprising a valve actuator and a link operatively connected with the valve actuator and the valve.

8. The cryogenic storage vessel of claim 2, wherein the receptacle is vertically oriented with a lower end, the lower end and the fluid communication channel both located near the bottom of the cryogen space; and the fluid communication channel configured to fluidly connect with a pump inlet when a pump is disposed inside the cryogenic storage vessel.

9. The cryogenic storage vessel of claim 2, wherein the fluid communication channel has a flexible construction that allows movement of the elongated inner sleeve relative to the elongated outer sleeve.

10. The cryogenic storage vessel of claim 9, wherein the flexible construction comprises a bellows arrangement.

11. The cryogenic storage vessel of claim 1, wherein the elongated inner sleeve is supported by the outer vessel.

12. The cryogenic storage vessel of claim 1, wherein the cooperating surface of the pump assembly is a flange and the outer vessel bears the axial load of the pump assembly through the flange when the pump assembly is installed in the cryogenic storage vessel.

13. The cryogenic storage vessel of claim 1, further comprising:

a purge valve in fluid communication with a supply of pressurized purging gas; and a first purge conduit fluidly connecting the purge valve with the warm end.

14. The cryogenic storage vessel of claim 13 further comprising a second purge conduit fluidly connecting the purge valve with the cold end.

15. The cryogenic storage vessel of claim 1 further comprising:

a drain valve in fluid communication with one of a second storage vessel and the cryogen space;

a first drain conduit fluidly connecting the drain valve with the warm end; and a second drain conduit fluidly connecting the drain valve with the cold end.

16. The cryogenic storage vessel of claim 15, further comprising a sensor detecting the concentration of gaseous fuel downstream from the drain valve.

17. The cryogenic storage vessel of claim 15, further comprising a pressure sensor detecting the pressure downstream from the drain valve.

18. The cryogenic storage vessel of claim 1, wherein a pump is installed in the cryogenic storage vessel.

19. The cryogenic storage vessel of claim 18, wherein a motor for driving the pump is installed in the cryogenic storage vessel.

20. The cryogenic storage vessel of claim 18, wherein a hydraulic motor for driving the pump is installed in the cryogenic storage vessel.

* * * * *